United States Patent [19]

Menchetti et al.

[11] Patent Number: 4,907,773

[45] Date of Patent: Mar. 13, 1990

[54] ADJUSTABLE MOUNTING SURFACE

[75] Inventors: Robert J. Menchetti, Buffalo; Robert M. Chapman, Lockport, both of N.Y.

[73] Assignee: National Gypsum Company, Dallas, Tex.

[21] Appl. No.: 232,199

[22] Filed: Aug. 15, 1988

[51] Int. Cl.[4] ..... F16M 13/00

[52] U.S. Cl. ..... 248/287; 248/297.2; 312/247

[58] Field of Search ..... 248/276, 287, 297.2, 248/298, DIG. 13; 312/246, 247

[56] References Cited

U.S. PATENT DOCUMENTS

| | | | |
|---|---|---|---|
| 1,509,470 | 9/1924 | Burgess | 248/250 |
| 1,807,356 | 5/1931 | Vance | 248/298 |
| 2,855,016 | 10/1958 | Crosby | 248/287 |
| 2,920,853 | 1/1960 | Bufogle | 248/287 |
| 2,931,612 | 4/1960 | Graber | 248/214 |
| 3,744,891 | 7/1973 | Dennis | 33/1 M |
| 3,865,338 | 2/1975 | Campbell | 248/297.2 |
| 4,033,539 | 7/1977 | Bardocz | 248/287 |
| 4,077,722 | 3/1978 | Bicskei | 248/DIG. 13 |

FOREIGN PATENT DOCUMENTS

| | | | |
|---|---|---|---|
| 16477 | 2/1978 | Japan | 248/287 |

*Primary Examiner*—Ramon O. Ramirez
*Assistant Examiner*—Robert A. Olson
*Attorney, Agent, or Firm*—Laird F. Miller; Robert F. Hause

[57] ABSTRACT

An assembly of elements for providing a mounting surface for wall furniture includes a bracket which is attached to a wall framing member, at least one horizontally extending, inwardly opening, horizontally adjustable channel mounted on the bracket and preferably a second vertically extending, inwardly opening, vertically adjustable channel mounted on the first channel, providing a mounting surface which is both horizontally and vertically adjustable, to accommodate wall furniture having mounting means which are not spaced to coincide with the spacing of the wall framing members.

13 Claims, 3 Drawing Sheets

ADJUSTABLE MOUNTING SURFACE

BACKGROUND OF THE INVENTION

This invention relates to the provision of a rigid sheet metal mounting surface in desired locations on a standard partition wall for affixing wall furniture thereto and is particularly directed to an assembly of parts which permit considerable adjustability in locating the metal mounting surface, relative to the location of the wall framing member to which the assembly is affixed.

Vertical wall framing members, such as the common vertical steel stud, are typically spaced apart 24 inches on center, and in most cases are only accessible through panel joints which are located 48 inches on center. Available wall cabinets come in many different widths and designs from numerous manufacturers. These cabinets will often not match the wall modular width, or if the cabinet matches the nominal width, the actual mounting locations on the cabinet will be at center-to-center dimensions other than the nominal 24 inches or 48 inches common for stud spacing and panel width.

SUMMARY OF THE INVENTION

The present invention provides a method, and the related structure, by which the support structures of a wall system are adjustable, vertically and horizontally, to match the mounting locations on a cabinet.

In the preferred form of the invention, an assembly is provided which includes (1) a bracket for rigid connection to a structural support, such as to a metal stud or to a horizontal metal channel which extends through a vertical metal stud, (2) a short length of inwardly opening channel, in which the bracket is horizontally adjustably mounted, and (3) a relatively longer vertically extending inwardly opening relatively wide channel, in which the short channel is vertically adjustably mounted. With such an assembly, the relatively longer and relatively wide channel provides a mounting surface which is adjustably mounted, adjustable vertically an amount substantially equal to the length of the longer channel and adjustable horizontally an amount substantially equal to the width of the longer channel.

When the two channels have been positioned, by horizontal and vertical adjustment, in the best position for mounting a cabinet thereon, a self-drilling, self-tapping screw is inserted through the webs of the two channels, to fix the vertical position of the longer channel, which then provides the mounting surface to which a cabinet is screwed, or otherwise suitably affixed.

If a wider horizontal adjustment is needed, the bracket can be used alone with the relatively longer channel, with the channel extending horizontally.

It is an object of the invention to provide a novel adjustable mounting surface to which wall furniture can be affixed.

It is a further object to provide an adjustable mounting surface of a highly simplified and economical form which provides a relatively wide range of adjustability.

It is a still further object to provide a novel method of mounting wall furniture and to provide a novel combination of wall furniture mounted on an improved mounting surface.

BRIEF DESCRIPTION OF THE DRAWINGS

These and other objects and advantages will be more readily apparent when considered in relation to the preferred embodiments of the invention as set forth in the specification and shown in the drawings in which:

Referring to FIG. 1, there is shown a wall furniture support assembly 10 consisting of a vertically disposed, horizontally adjustable bracket 12, mounted within a short section of horizontally extending channel 14, which is vertically adjustably mounted within a relatively longer section of vertically extending channel 16, which channel 16 is intended to provide a mounting surface for wall furniture.

Figure 1:
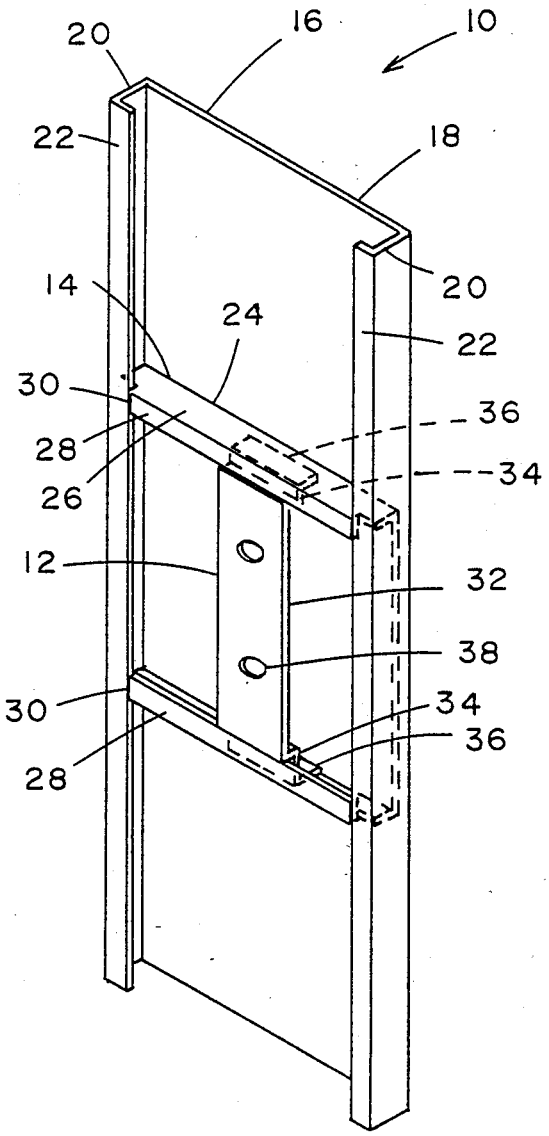
FIG. 1 is an isometric view of an assembly of a bracket horizontally adjustably mounted within a short section of horizontally extending channel which is vertically adjustably mounted within a relatively longer section of vertically extending channel, which latter channel provides a mounting surface for wall furniture.

In the preferred embodiment, the bracket 12, the short channel 14 and the long channel 16 are all formed from 1/16-inch thick galvanized steel.

The long channel 16 is about 12 inches long, and includes a front face 18, about four inches wide, a rearwardly extending side flange 20, about one-half inch wide, along each side edge of front face 18, and inwardly directed back flanges 22, about one-quarter inch wide, along the back edge of each side flange 20.

The short channel 14 includes a front face 24 also about four inches wide, a rearwardly extending side flange 26, about 7/16-inch wide, along each side edge of front face 24, and inwardly directed back flanges 28, about one-quarter inch wide, along the back edge of each side flange 26. The back flanges 28 each have each end 30 cut away about one-quarter inch, relative to the length of the front face 24 and the side flanges 26. The front face 24 and the side flanges are about three-and-thirteen sixteenths-inches long, so that they fit between the side flanges 20 of long channel 16. The back flanges 28 are about three-and-a-quarter-inches long, so that they fit between the back flanges 22 of long channel 16.

The short channel 14 is mounted within the long channel 16 with flanges 26 and 28 of short channel 14 extending perpendicular to the lengthwise extent of long channel 16.

Figure 4:
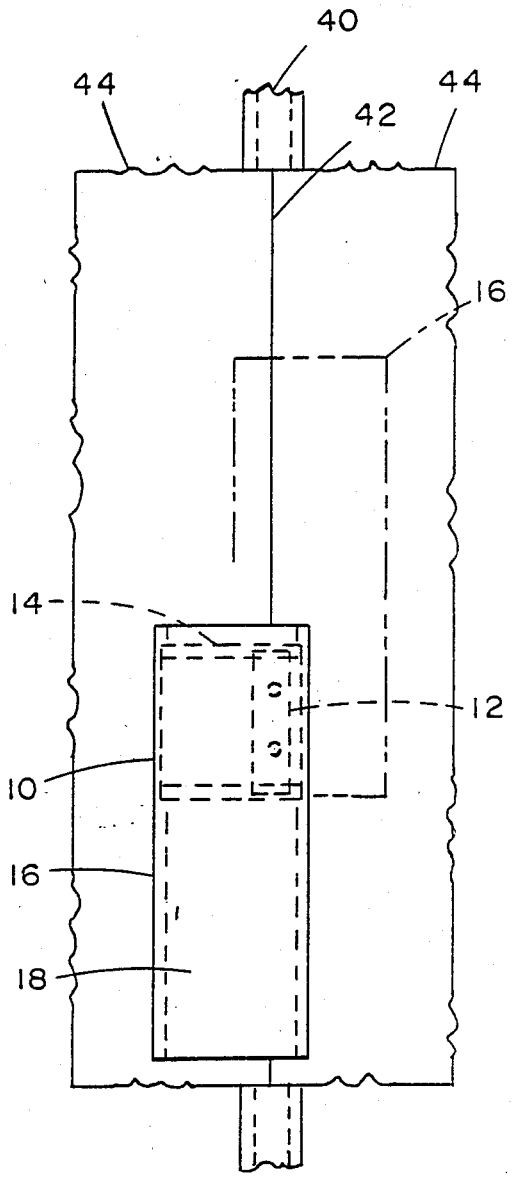
FIG. 4 is a face view of the assembly of FIG. 1 with the bracket attached to a stud at a wallboard joint, showing the extent of adjustability of the vertically extending channel which functions as a mounting surface.
Figure 5:
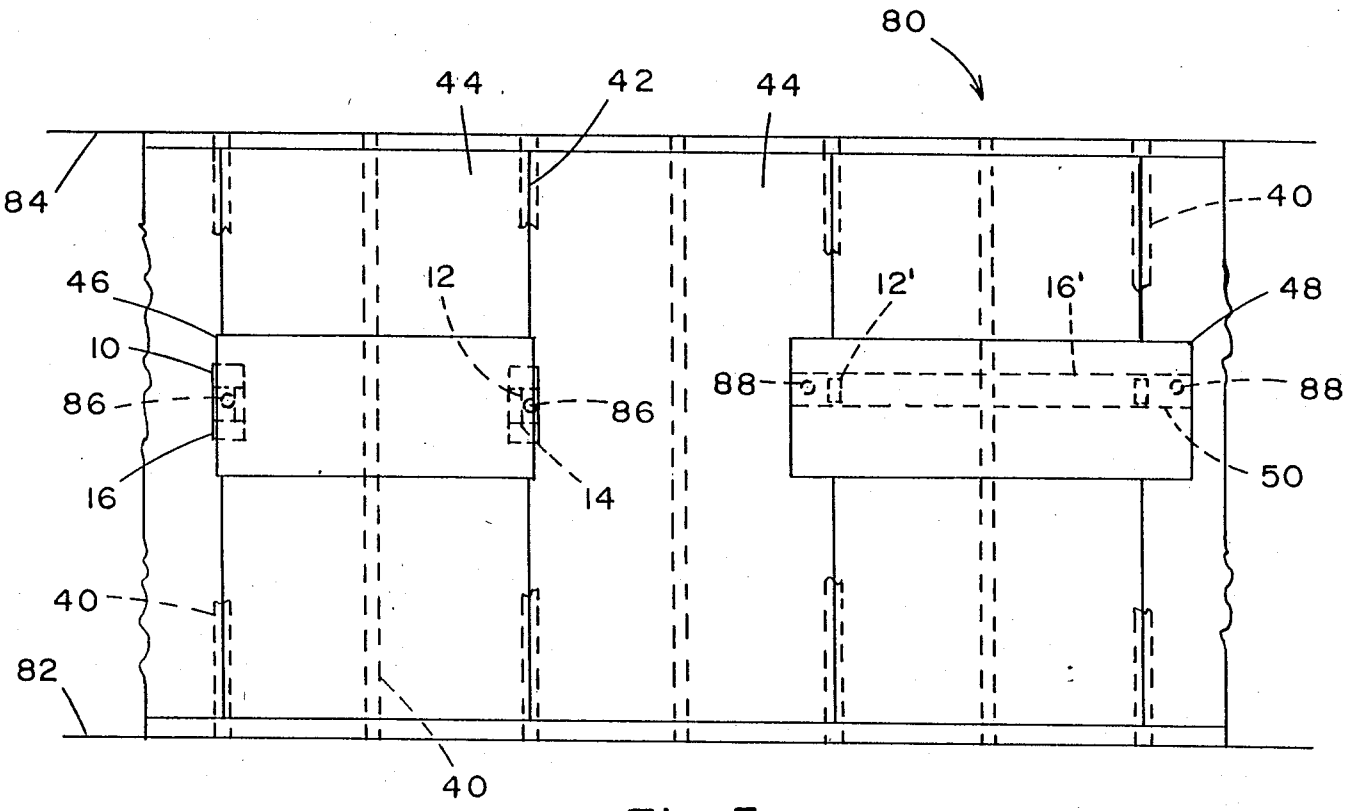
FIG. 5 is a face view of a wall showing two wall cabinets with varying locations of mounting means on the back of the cabinets, showing the mounting locations and the bracket locations, all relative to the wall panels and studs.

The bracket 12 consists of a vertically extending strip of metal which includes a vertically extending narrow mid-section 32 which when mounted extends between back flanges 28, a pair of frontwardly stepped portions 34 which are disposed between the respective back flanges 28 and the front face 24 of short channel 14, and a pair of frontwardly directed end flanges 36 which are disposed immediately inwardly of the short channel side flanges 26, maintaining the stepped portions 34 closely adjacent the short channel back flanges 28. Mid-section 32 includes two holes 38 for screw attachment of the bracket to a wall stud 40; FIGS. 4 and 5.

The bracket 12 fits within the short channel 14, as shown, with just sufficient tolerance to be movable freely from one end to the other end of the back flanges 28 of the short channel 14.

The short channel 14 fits within the long channel 16, as shown, with just sufficient tolerance to be movable freely from one end to the other end of the long channel 16.

In use, the vertical bracket 12 is screw attached to a vertical wall stud 40, the short channel 14 is slid horizontally over the forwardly stepped portions 34 and then the long channel 16 is slid vertically over the two respective ends 30 of the short channel 14.

FIG. 4 shows, diagrammatically, the assembly 10 mounted over a joint 42 between two wallboards 44, with the bracket 12 disposed over the joint 42, screw attached to the stud 40 which is located immediately behind the wallboard joint 42. When the bracket 12 is attached to the wall, the back flanges 22 and 28 will be held closely adjacent the surface of wallboards 44. The long channel 16 is shown in solid lines at about the lowest left-most position to which it can be moved by reason of the vertically movable relationship of the long channel 16 on the short channel 14 and the horizontally movable relationship of the short channel 14 on the bracket 12.

The long channel 16 is also shown in phantom lines at about the uppermost right-most position to which it can be moved, it being understood that it can also be moved to the upper left, the lower right or to any position therebetween.

Prior to attaching any wall furniture to the long channel 16, the front face 18 of which provides a mounting surface, the long channel 16 is positioned suitably for attaching the wall furniture, such as cabinets 46, 48 in FIG. 5. When the long channel 16 is positioned suitably, at least one self-drilling, self-tapping screw is placed through the front face 18 of the long channel and on through the front face 24 of the short channel, locking the long channel 16 to a fixed vertical position.

The long channel 16 is now also limited in the extent to which it can be moved horizontally by the inability of the bracket 12 to move relative to the short channel 14 any further than between the back flanges 22 of the long channel 16.

Figure 2:
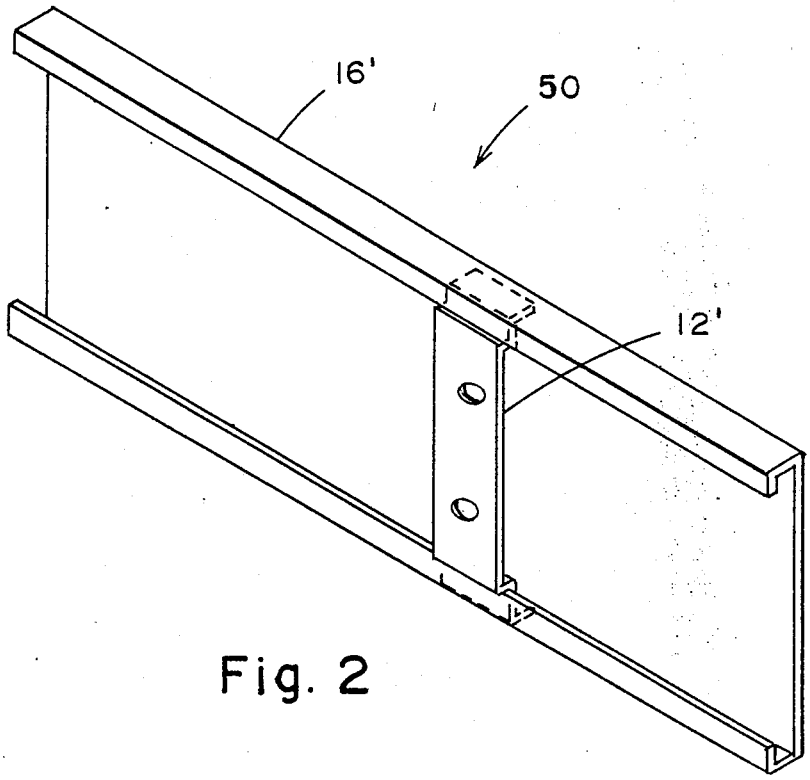
FIG. 2 is an isometric view of the bracket of FIG. 1 horizontally adjustably mounted within the relatively longer section of channel, with the channel extending horizontally and providing a mounting surface for wall furniture.

In a second embodiment of the invention, an assembly 50 is shown, in FIG. 2, consisting of some of the same elements as are in assembly 10. In assembly 50, the long channel 16' extends horizontally and is mounted directly on to the vertically extending bracket 12'. Thus, when bracket 12' is screw attached, vertically, to a frame element, such as a stud, the long channel 16' can provide a mounting surface for wall furniture which is further horizontally from the stud, and thus from bracket 12', than can be provided by assembly 10.

Figure 3:
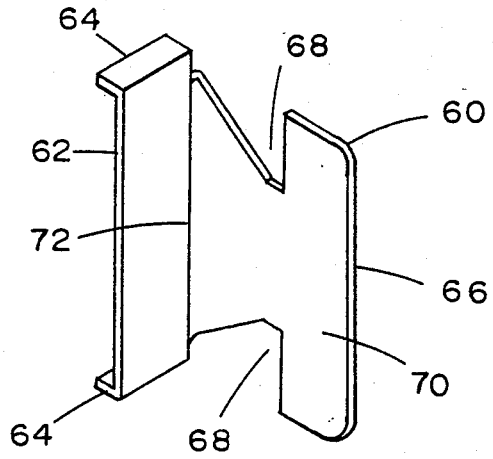
FIG. 3 is an isometric view of a modified form of bracket, suitable for use in the combinations of FIGS. 1 and 2.

A modified form of bracket 60 is shown in FIG. 3, consisting of a vertical base section 62, which when mounted extends between the side flanges 26 of short channel 14, and a pair of frontwardly directed end flanges 64 which are disposed immediately inwardly of the short channel side flanges 26, maintaining the base section 62 closely adjacent the short channel back flanges 28.

Extending perpendicularly rearwardly from the base section 62 is a precut flat steel double hook 66. The double hook 66 includes two oppositely directed slots 68 formed in a flat sheet 70 of steel which forms double hook 66, and the flat sheet 70 is adjoined to the base section 62 along one lateral edge 72 of base section 62. The slots 68 are formed to provide a means for affixing the bracket to a slotted stud, of the type commonly used for mounting wall furniture. By providing two opposed slots 68, the double hook 66 is made reversible. By being reversible, the base section 62 can be placed on either side of the double hook 66. This extends the range of adjustability of the double hook 66 relative to the short channel length by an amount equal to the width of the base section.

FIG. 5 shows a wall 80, disposed between a floor 82 and a ceiling 84, with four-foot-wide wallboards 44 mounted on studs 40, which are vertically mounted on two-foot centers along the wall 80. Two cabinets 46, 48 are shown mounted on the wall 80.

Cabinet 46 is mounted on two assemblies 10, 10, with the brackets 12, 12 each located at a joint 42. Cabinet 46 is approximately 48 inches wide, with cabinet mounting locations 86 placed about two inches in from each end of the cabinet. The long channels 16, 16 of the two assemblies 10, 10 are located as near to the vertical center of cabinet 46 as possible and vertically fixed by a self-drilling, self-tapping screw through the two channels 14, 16 of each assembly 10, 10.

Thus the front face 18 of each of the two long channels 16, 16 of the two assemblies 10, 10 are located and fixed, vertically, suitably for mounting the cabinet 46 thereon.

Cabinet 48, in FIG. 5, is a 60-inch-wide cabinet 48, with mounting locations 88, 88 spaced outwardly about five inches, horizontally, from the brackets 12' 12' of the assembly 50. The long channel 16' extends horizontally, and is positioned, relative to brackets 12' 12' to provide a mounting surface at the mounting locations 88, 88 of cabinet 48.

Having completed a detailed disclosure of the preferred embodiments of our invention, so that others may practice the same, we contemplate that variations may be made without departing from the essence of the invention.

We claim:

1. An adjustable mounting surface assembly comprising a metal bracket and at least one rearwardly opening channel, said at least one channel including one channel having a horizontally extending disposition, means on said metal bracket for affixing said bracket to a wall framing member, said bracket having a pair of means located respectively at the top and the bottom ends of said bracket for adjustably engaging said one horizontally extending, rearwardly opening channel, said one horizontally extending, rearwardly opening channel having a front face substantially equal in width to the height of said bracket, rearwardly extending elongate side flanges along the top and the bottom edges of said one horizontally extending rearwardly opening channel, and inwardly extending elongate back flanges extending inwardly from the rearward edges of said side flanges, said adjustably engaging means on said bracket being disposed between said one horizontally extending, rearwardly opening channel front face and said back flanges, at least one of said rearwardly opening channels having a mounting surface for wall furniture, which said mounting surface is mounted for adjustable positioning relative to said bracket by reason of said adjustable engagement of said horizontally extending, rearwardly opening channel on said top and bottom ends of said bracket, said at least one rearwardly opening channel being free of any element extending rearwardly of said inwardly extending elongate back flanges whereby said channels are able to be adjustably mounted closely adjacent a wall surface with said back flanges closely adjacent said wall surface, wherein said assembly includes two rearwardly opening channels, said two channels consisting of said one relatively short horizontally extending channel horizontally adjustably mounted on said bracket and one vertically extending, vertically adjustable relatively long channel, said long channel having two vertically extending side edges, and having rearwardly extending elongate side flanges along said vertically extending side edges of said long channel and inwardly extending elongate back flanges extending inwardly from the rearward edges of said long channel side flanges, said short channel having vertical ends disposed between said long channel front face and said long channel back flanges, and said long channel having a mounting surface for wall furniture on said long channel front face, said mounting surface having adjustability of position relative to said bracket in both horizontal and vertical directions.

2. An assembly as defined in claim 1 wherein said bracket consists essentially of a base section with frontwardly directed end flanges and a perpendicularly extending flat sheet, said flat sheet being formed to include at least one hook for engaging a slotted wall stud.

3. An assembly as defined in claim 1 wherein said bracket consists essentially of a strip of metal which includes a mid-section and two opposed end portions, said end portions providing said adjustably engaging means on said bracket.

4. An assembly as defined in claim 3 wherein said mid-section has said means for affixing said bracket to a wall framing member.

5. An assembly as defined in claim 4 wherein said means for affixing said bracket to a wall framing member consists of holes for the passage therethrough of fasteners.

6. A wall structure comprising vertical wall framing members, a plurality of vertically disposed wallboards affixed to said framing members, at least one adjustable mounting surface assembly affixed to said wall framing member, and a wall cabinet mounted on said wall, said adjustable mounting surface assembly comprising a metal bracket and at least one rearwardly opening channel, said at least one channel including one channel having a horizontally extending disposition, means on said metal bracket for affixing said bracket to a wall framing member, said bracket having a pair of means located respectively at the top and the bottom ends of said bracket for adjustably engaging said one horizontally extending, rearwardly opening channel, said one horizontally extending, rearwardly opening channel having a front face substantially equal in width to the height of said bracket, rearwardly extending elongate side flanges along the top and the bottom edges of said one horizontally extending rearwardly opening channel, and inwardly extending elongate back flanges extending inwardly from the rearward edges of said side flanges, said adjustably engaging means on said bracket being disposed between said one horizontally extending, rearwardly opening channel front face and said back flanges, at least one of said rearwardly opening channels having a mounting surface for wall furniture, which said mounting surface is mounted for adjustable positioning relative to said bracket by reason of said adjustable engagement of said horizontally extending, rearwardly opening channel on said top and bottom ends of said bracket, said at least one rearwardly opening channel being free of any element extending rearwardly of said inwardly extending elongate back flanges whereby said channels are able to be adjustably mounted closely adjacent a wall surface with said back flanges closely adjacent said wall surface, said cabinet having wall mounting means which are located at and mounted on said mounting surface on one of said rearwardly opening channels.

7. A wall structure as defined in claim 6 wherein said means on said bracket for affixing said bracket to a wall framing member consists of screw holes, and said assembly bracket is screw attached to one of said framing members.

8. A wall structure as defined in claim 6 wherein said framing members include a vertical stud having a slotted surface, and wherein said assembly bracket includes a rearwardly extending plate having at least one hook formed therein, which said hook forms said means on said bracket for affixing said bracket to a wall framing member, said hook being engaged in said stud slotted surface whereby said assembly is affixed to said framing member.

9. A wall structure as defined in claim 8 wherein said rearwardly extending plate is affixed to a base section along one lateral edge of said base section, said plate having a pair of oppositely directed hooks formed therein, whereby said bracket is reversible.

10. The method of mounting wall furniture comprising the steps of affixing an adjustable mounting surface assembly to a wall, said adjustable mounting surface assembly comprising a metal bracket and at least one rearwardly opening channel, said at least one channel including one channel having a horizontally extending disposition, means on said metal bracket for affixing said bracket to a wall framing member, said bracket having a pair of means located respectively at the top and the bottom ends of said bracket for adjustably engaging said one horizontally extending, rearwardly opening channel, said one horizontally extending, rearwardly opening channel having a front face substantially equal in width to the height of said bracket, rearwardly extending elongate side flanges along the top and the bottom edges of said one horizontally extending rearwardly opening channel, and inwardly extending elongate back flanges extending inwardly from the rearward edges of said side flanges, said adjustably engaging means on said bracket being disposed between said one horizontally extending, rearwardly opening channel front face and said back flanges, at least one of said rearwardly opening channels having a mounting surface for wall furniture, which said mounting surface is mounted for adjustable positioning relative to said bracket by reason of said adjustable engagement of said horizontally extending, rearwardly opening channel on said top and bottom ends of said bracket, said at least one rearwardly opening channel being free of any element extending rearwardly of said inwardly extending elongate back flanges whereby said channels are able to be adjustably mounted closely adjacent a wall surface with said back flanges closely adjacent said wall surface, said steps comprising affixing said bracket to a wall framing member and adjustably engaging said at least one rearwardly opening channel onto said bracket, said at least one channel providing at least a degree of horizontal adjustability to said mounting surface, and mounting a piece of wall furniture on said mounting surface.

11. The method of claim 10, said method further comprising the step of mounting a relatively long vertically adjustable, vertically extending rearwardly opening channel on said one horizontally adjustable channel, whereby said vertical channel provides a mounting surface which is both horizontally and vertically adjustable relative to said affixed bracket.

12. The method of claim 10 wherein said means on said bracket for affixing said bracket to a wall framing member consists of screw holes, and said bracket is affixed to a wall framing member by screw attachment.

13. The method of claim 10 wherein said bracket is affixed to a wall framing member by a hook on said bracket engaging hook retaining means on said framing member, which said hook forms said means on said bracket for affixing said bracket to a wall framing member.

* * * * *